US006213598B1

(12) United States Patent
Hou et al.

(10) Patent No.: US 6,213,598 B1
(45) Date of Patent: Apr. 10, 2001

(54) PRESSURE CONTROL DEVICE

(75) Inventors: I. C. Hou, Hsinchu; Chi-Chien Lin, Hsinchu Hsien, both of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/248,934

(22) Filed: Feb. 12, 1999

(30) Foreign Application Priority Data

Sep. 30, 1998 (TW) ..... 87116229

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 5,537,134 * 7/1996 Baldwin et al. ..... 347/85
5,812,155 * 9/1998 Seccombe ..... 347/6
5,933,175 * 8/1999 Stathem et al. ..... 347/87
5,988,803 * 11/1999 Komplin et al. ..... 347/86

* cited by examiner

*Primary Examiner*—N. Le
*Assistant Examiner*—Michael Nghiem
(74) *Attorney, Agent, or Firm*—Thomas, Kayden, Horstemeyer & Risley

(57) ABSTRACT

A pressure control device installed at the bottom of the reservoir of an ink-jet pen. The device has a tubular boss whose upper end has an arc surface and that a sphere sits on the arc surface. Ideally, the sphere makes a line contact with the arc surface of the boss. The device also has a spring with one end mounted to the bottom of the reservoir. The spring has two portions together. The first portion of the spring presses tightly against the sphere while the second portion touches a pressure plate inside the reservoir. The reservoir further contains an expandable bag. When the bag inside the reservoir expands, the pressure plate attached to the bag will push the second portion of the spring such that its first portion will move away from the sphere. Due to the presence of a back pressure within the reservoir, the sphere will be afloat briefly permitting ambient air to enter the reservoir. Consequently, back pressure within the reservoir is regulated.

10 Claims, 11 Drawing Sheets

PRESSURE CONTROL DEVICE

CROSS-REFERENCE TO RELATED APPLICATION

This application claims the priority benefit of Taiwan application serial no. 87116229, filed Sep. 30, 1998, the full disclosure of which is incorporated herein by reference.

BACKGROUND OF THE INVENTION

1. Field of Invention

The present invention relates to a pressure control device. More particularly, the present invention relates to a pressure control device for controlling the pressure within the ink reservoir of an ink-jet pen.

2. Description of Related Art

Conventional ink-jet printing generally relies on the controlled delivery of ink droplets from an ink-jet pen ink reservoir to a print medium. Among the printing methods for delivering ink drops from the ink reservoir to the print head, drop-on-demand printing is known as the commonly used method. Drop-on-demand method typically uses thermal bubble or piezoelectric pressure wave mechanisms. A thermal bubble type print head includes a thin film resistor that is heated to cause sudden vaporization of a small portion of ink. The vapid expansion of the ink vapor forces a small drop of ink through a print head nozzle.

Although drop-on-demand printing is ideal for sending ink drops from an ink reservoir to the print head, some mechanism must be included to prevent ink leaking out from the print head when the print head is inactive. Such a mechanism usually can build a slight back pressure at the print head to prevent ink leakage from the pen whenever the print head is inactive. Herein, the term "back pressure" represents the partial vacuum within the ink reservoir. Back pressure is defined in the positive sense so that an increase in back pressure means the degree of partial vacuum has increased.

When back pressure is established at all times inside the reservoir, ink is prevented from permeating through the print head. However, the back pressure can not be so high that the print head is unable to overcome the back pressure to eject ink drops. Furthermore, as ambient air pressure decreases, a corresponding greater amount of back pressure is needed to keep ink from leaking. Accordingly, back pressure within the ink-jet pen has to be regulated whenever ambient pressure drops. Also the pressure within the pen is subjected to what may be termed "operational effects". It is because the depletion of ink from the ink reservoir increases the reservoir back pressure. Without regulation of this back pressure increase, the ink-jet pen will fail soon because the back pressure is too high that the print head can not overcome it to eject ink drops.

Conventionally, the back pressure within the ink reservoir is controlled by a mechanism referred to as accumulators. In general, an accumulator includes an elastomeric bag capable of moving between a minimum volume position and a maximum volume position is response to changes in the back pressure within the ink reservoir. For example, as ambient pressure drops so that back pressure within the reservoir decreases simultaneously, the accumulator will move to increase the reservoir volume to thereby increase the back pressure to a level that prevent ink leakage. Another example is the depletion occurring during operation of the pen. In such a case, accumulators will move to decrease the reservoir volume to reduce the back pressure to a level within the operation range, thereby permitting the print head to continue ejecting ink.

However, although the accumulators such as elastomeric bags can adjust automatically the reservoir volume to keep the back pressure within the operation range, the extent to which elastomeric bags are capable of expanding is quite limited. Consequently, when ink gradually drops from the print head, the bag may reach its maximum extent and therefore incapable of any further adjustment of the reservoir volume. Hence, back pressure within the reservoir may increase such that ink droplets are prevented from coming out of the print head.

To resolve the aforementioned problems, some ink-jet pens employ a device called a "bubble generator". The bubble generator has an orifice through which ambient air can enter the reservoir. The dimension of the orifice is such that ink is trapped within the orifice to seal off the reservoir by capillary effect. When ambient air pressure is high enough to overcome the liquid seal, air can bubble into the ink-jet reservoir. Therefore, back pressure within the reservoir can decrease and capillary effect will take over and re-establish the liquid seal again to prevent entrance of more air bubbles.

In general, bubble generators of ink-jet pens must satisfy a few conditions. Firstly, the bubble generator must be able to control back pressure precisely. Secondly, The range of fluctuation of the back pressure within the reservoir must be as small as possible. In other words, as air bubbles enter the reservoir leading to a drop of back pressure, the bubble generator must be able to stop the entrance of bubbles soon enough so that a suitable back pressure remains inside. Thirdly, the bubble generator must have self-wetting capability. The liquid seal must be able to prevent the entrance of bubbles even when most of the ink within the reservoir is used up, or alternately when the ink-jet pen is tilted so much that the bubble generator is no longer immersed below the ink.

FIG. 1 is a cross-sectional diagram showing a conventional design of the bubble generator according to U.S. Pat. No. 5,526,030. The bubble generator installed within the reservoir 102 has an orifice 104 and a sphere 106. FIG. 2 is top view showing the surrounding structure of the bubble generator. As show in FIG. 2, the internal sidewalls of the orifice 104 contains equidistantly spaced protruding ribs 108 for centering the sphere 106. The circular gap 110 between the sphere 106 and the orifice 104 is location where ambient bubbles are produced.

Normally, a bubble generator such as above is able to meet the demands required for printing with an ink-jet pen. In general, the entrance of bubbles into the ink-jet pen 102 is determined by surface tension of the ink itself, static pressure of the ink column and the gap 110 between the sphere 106 and the orifice 104. Usually, the greater the surface tension of the ink or smaller the gap between the sphere and the orifice, the higher will be the back pressure required within the reservoir before air bubbles will start to enter. In addition, static pressure of the ink column within the reservoir can affect the value of back pressure required before air bubbles begin to enter the reservoir. Therefore, as ink gradually drops, static pressure of the ink column will decrease leading to the entrance of air bubbles at a smaller back pressure. In summary, major drawbacks of the aforementioned pressure control technique includes:

1. The value of back pressure within the ink-jet reservoir before bubble generator starts to function is related to surface tension of the ink used. Since various ink may have different surface tension, the minimum back pressure under which air bubbles can enter the reservoir may be different for each type of ink. Consequently, the gap between the sphere and the orifice must be designed for various ink.

2. The value of back pressure within the reservoir before bubble generator starts to function is also related to the static pressure generator by the column of ink. As ink within the reservoir drops gradually, static pressure acting on the bubble generator will drop making it easier for air bubbles to enter the reservoir. Often this will lead to a lowering of back pressure within the reservoir, and the adjustable range of the accumulator will be reduced.

3. The gap between the sphere and the orifice has to be precisely engineered to permit the entrance of air bubbles at the correct back pressure within the reservoir. This will increase difficulties in fabricating the reservoir of an ink-jet pen.

In light of the foregoing, there is a need to provide a better pressure control device within an ink-jet reservoir.

SUMMARY OF THIS INVENTION

Accordingly, the present invention is to provide a pressure control device capable of restricting the variation of back pressure within the ink-jet reservoir due to a dropping ink level through normal printing operation.

In another aspect, this invention provides a pressure control device whose controlling mechanism is independent of the ink used in the reservoir. In other words, back pressure within the reservoir is unaffected by the type of ink used.

To achieve these and other advantages and in accordance with the purpose of the invention, as embodied and broadly described herein, the invention provides a pressure accumulator. The pressure control device is capable of adjusting back pressure within the reservoir, comprising a pressure plate; an expandable bag with one side attached to a first interior sidewall of the sealed reservoir and the other side attached to one side of the pressure plate, wherein the expandable bag further includes a short venting pipe passing through the sealed reservoir for communicating with air outside; and a spring device with one end attached to the other side of the pressure plate while the other end of the spring is attached to a second interior sidewall on the opposite side of the first interior sidewall of the sealed reservoir.

Another variation pressure accumulator within a sealed reservoir is provided, comprising a first and a second pressure plates; a first expandable bag with one side attached to a first interior sidewall of the sealed reservoir and the other side attached to one side of the first pressure plate, and a second expandable bag with one side attached to a second interior sidewall of the sealed reservoir and the other side attached to one side of the second pressure plate; and a spring device with one end attached to the other side of the first and the second pressure plates.

To achieve these and other advantages and in accordance with the purpose of the invention, as embodied and broadly described herein, the invention provides a pressure control device. The pressure control device is capable of adjusting back pressure within the reservoir similar to a bubble generator. The device is installed at the bottom of the reservoir. The device has an orifice whose upper end has an arc surface and that a sphere sits on the arc surface. Ideally, the sphere makes a line contact with the arc surface of the orifice. The device also has a flat spring with one end riveted onto the bottom of the reservoir. The flat spring has two portions: the first portion of the flat spring presses tightly against the sphere while the second portion touches a pressure plate within the reservoir. The reservoir further contains an expandable bag. When the bag within the reservoir expands, the pressure plate will push the second portion of the flat spring forward such that its first section will move away from the sphere. Due to the presence of a back pressure inside the reservoir, the sphere will be afloat briefly permitting ambient air to enter the reservoir through the orifice.

As soon as ambient air enters the reservoir, back pressure within the ink-jet reservoir will drop. Therefore, the bag within the reservoir will start to contract with the assistance of a spring. Very soon, force on the pressure plate that pushes against the second portion of the flat spring will be removed, and the flat spring will return to its former position. In other words, the first portion of the flat spring is once more pressing tightly against the sphere, and air bubbles can no longer enter the reservoir through the orifice.

Using the pressure control device of this invention, even when most of the ink is used, a back pressure within the reservoir can still maintain within a desirable level.

It is to be understood that both the foregoing general description and the following detailed description are exemplary, and are intended to provide further explanation of the invention as claimed.

BRIEF DESCRIPTION OF THE DRAWINGS

The Accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE REFERRED EMBODIMENTS

Figure 1:
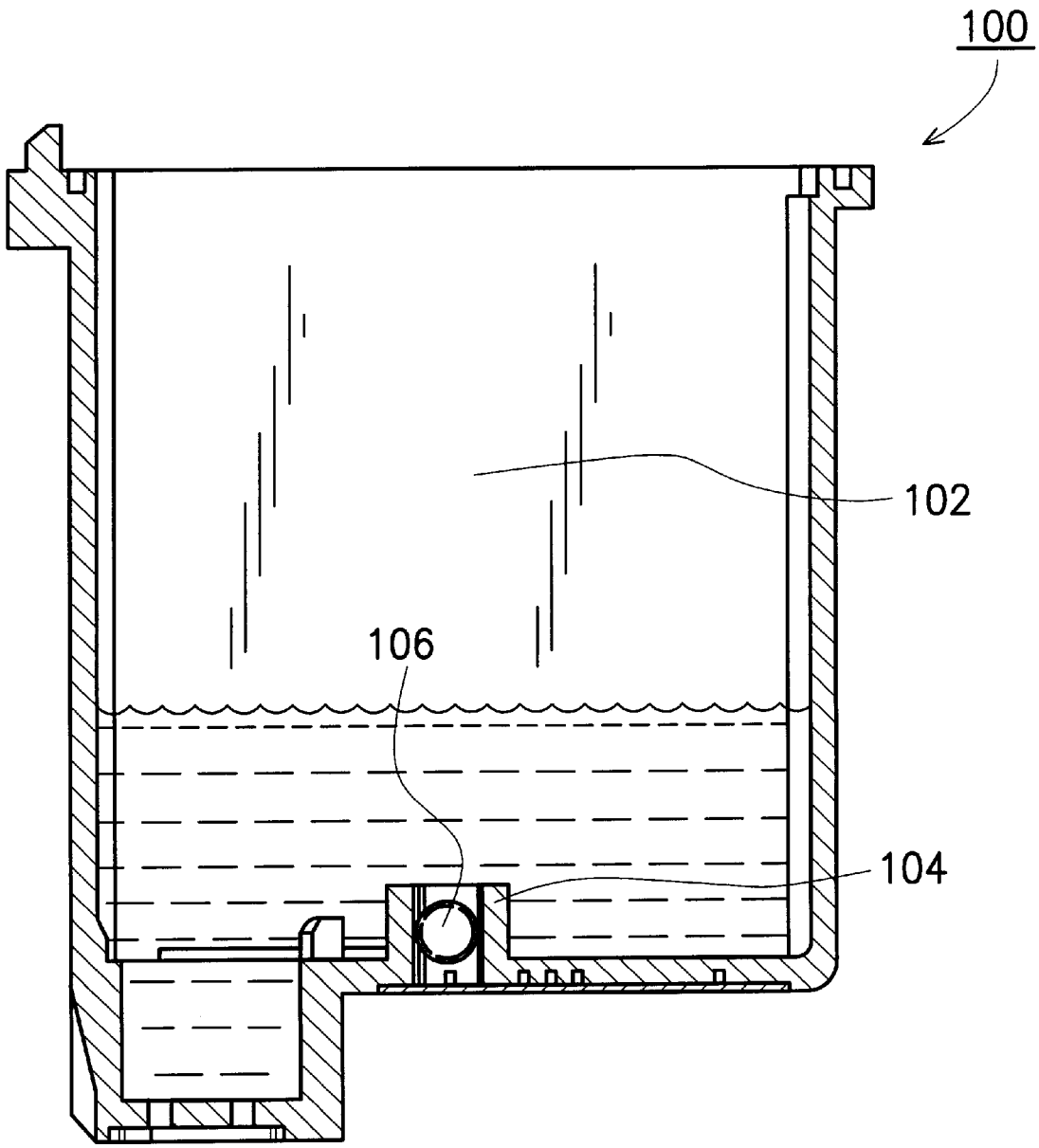
FIG. 1 (PRIOR ART)
FIG. 1 is a cross-sectional diagram showing a conventional in-jet reservoir having a bubble generator inside.
Figure 2:
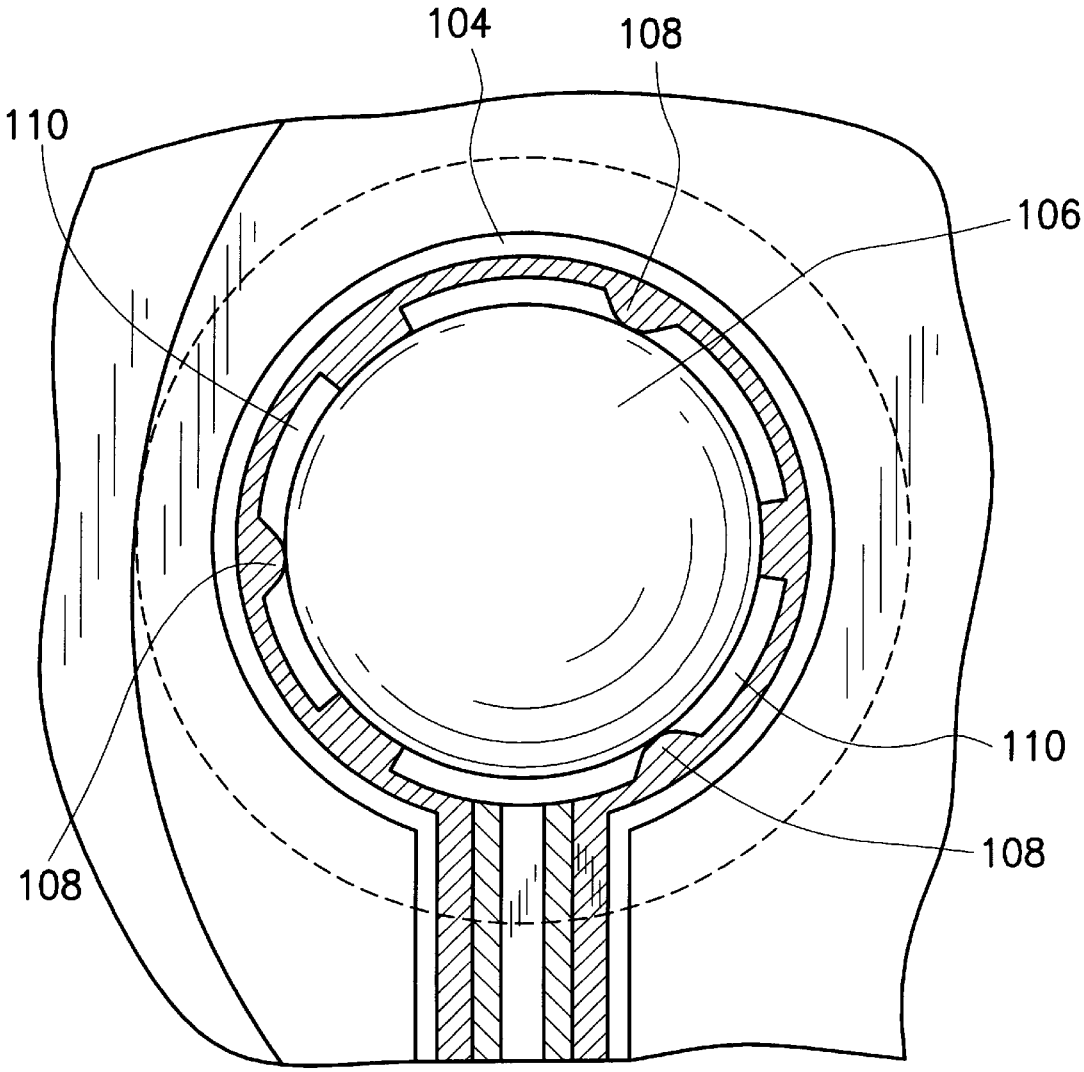
FIG. 2 (PRIOR ART)
FIG. 2 is a top view of the bubble generator illustrated in FIG. 1.

Reference will now be made in detail to the present referred embodiments of the invention, examples of which are illustrated in the accompanying drawings. Wherever possible, the same reference numbers are used in the drawings and the description to refer to the same or like parts.

EXAMPLE 1

Figure 3A:
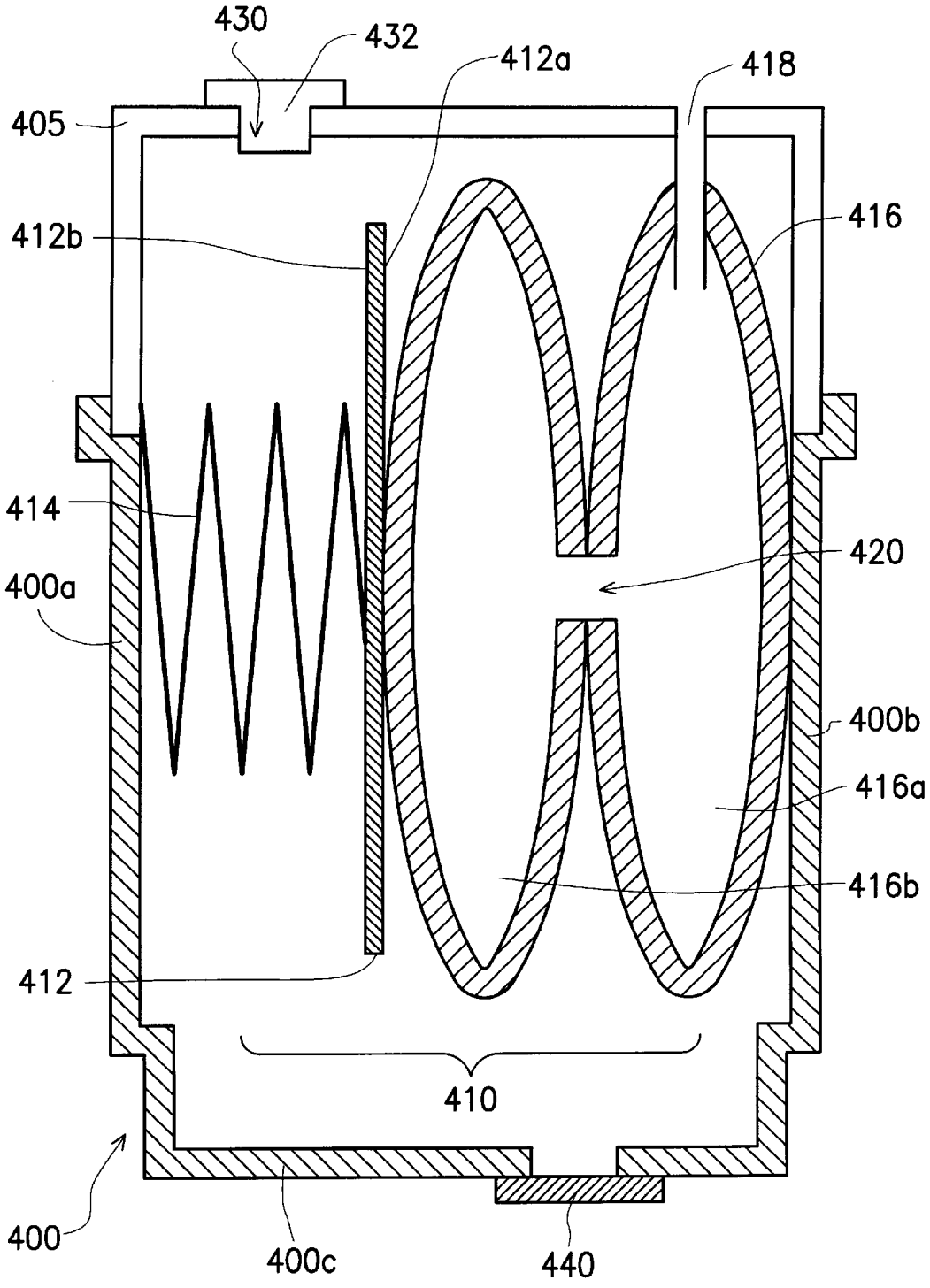
FIGS. 3A and 3B are cross-sectional views showing the components inside an ink-jet pen including an expandable bag in the expanded/contracted position according to the embodiment of this invention.
Figure 3B:
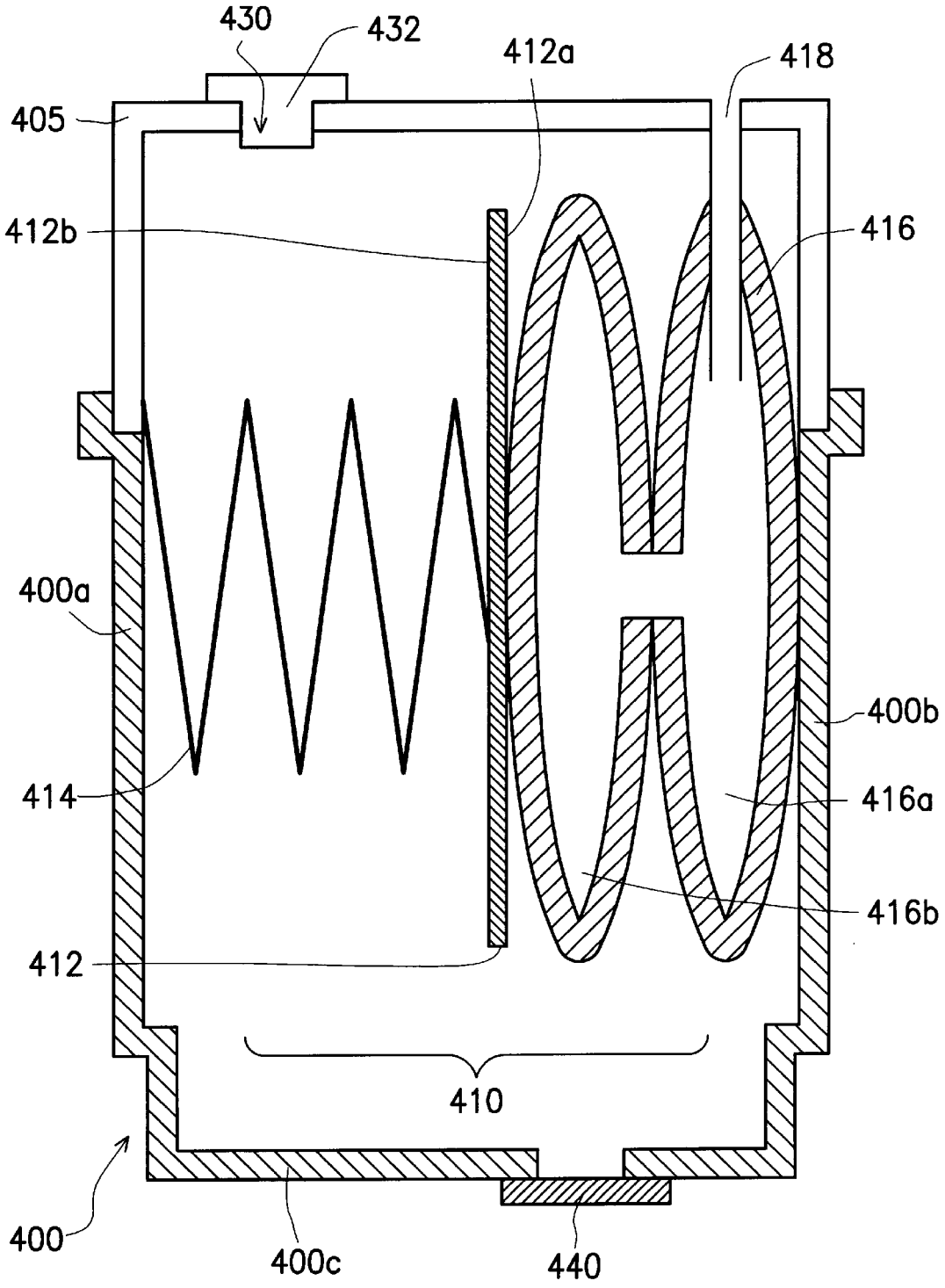

FIGS. 3A and 3B are cross-sectional views showing the components inside an ink-jet pen including an expandable bag 416 in the contracted position to the embodiment of this invention. As show in FIG. 3A, the ink-jet pen 400 is actually a reservoir having rigid sidewalls 400*a*, 400*b*, 400*c* and a cap 405. Inside the ink-jet pen 400, there is an accumulator 410. The accumulator 410 is in fact an assembly of components that includes a pressure plate 412, a spring 414 and an expandable bag 416. The bag 416 further includes a first chamber 416*a* and a second chamber 416*b*. The first chamber 416*a* is connected to ambient air via a connecting pipe 418. Consequently, ambient air is able to flow into and out of the bag 416. The connecting pipe 418 passes through the cap 405 of the ink-jet pen with its end tightly sealed. Therefore, the only path for air into and out of the bag is through the connecting pipe 418. Between the first chamber 416*a* and the second chamber 416*b*, there is an opening 420 permitting the flow of air between the chambers.

One side of the bag 416 is in contact with the inner side wall 400*b* of the ink-jet pen 400 while the other side of the bag 416 is in contact with the first side 412*a* of the pressure plate 412. The second side 412*b* of the pressure plate 412 is supported by one end of the spring 414 while the other end of the spring 414 is supported by the inner side wall 400*a* of the ink-jet pen 400.

With the accumulator 410 in place, the reservoir is filled with ink through a sealable port 430. After the ink-jet pen 400 is filled, a seal cap 432 is used to seal off the port 430 so that the ink-jet pen 400 is cut off from direct contact with the atmosphere. At this moment, a minimum back pressure is established within the pen reservoir. The minimum back pressure can prevent ink leaking through the print head 440 when the print head 440 is inactive.

When the ink-jet pen 400 is used for printing, the air pressure within the reservoir decreases as ink is depleted. Hence, the back pressure increases. During printing, the bag 416 will then expand as shown in FIG. 3A. As the bag 416 expands, it will push on the pressure plate 412 and compress the spring 414 thereby reducing the volume of the reservoir to maintain the reservoir back pressure within a adequate level such that the print head 440 is able to continue ejecting ink from the reservoir.

When ambient air pressure decreases, for example, during air transportation of the pen, the spring 414 will push the pressure plate 412 against the bag 416 so that the bag 416 will contract due to a lower ambient pressure, as shown in FIG. 3B. The contraction of the bag 416 will increase the volume of the pen reservoir so that the back pressure within the reservoir, relative to ambient, does not drop to a level that permits ink to leak from the print head 440.

EXAMPLE 2

Figure 4A:
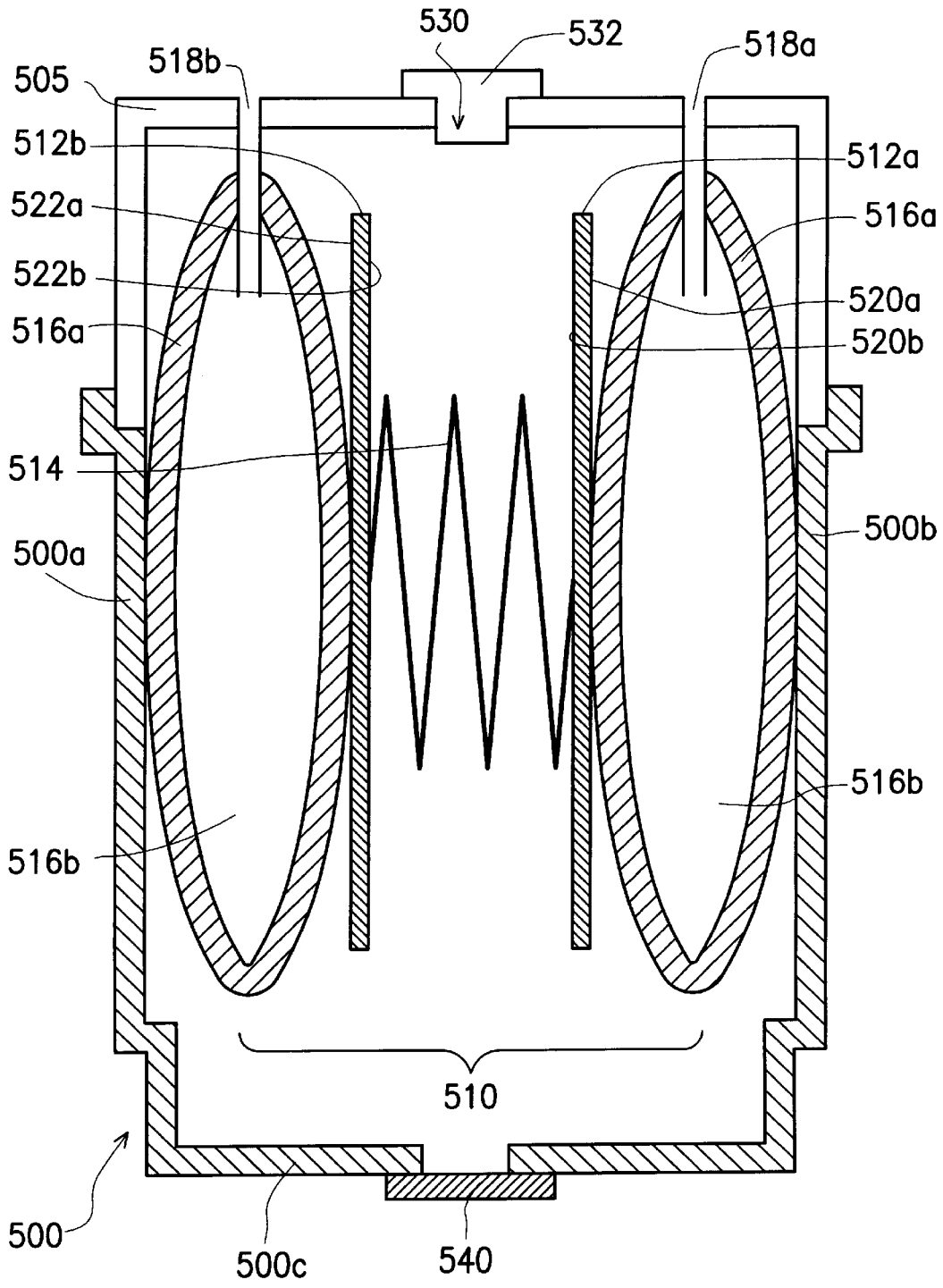
FIGS. 4A and 4B are cross-sectional views showing the components inside an ink-jet pen including an expandable bag in the expanded/contracted position according to another embodiment of this invention.
Figure 4B:
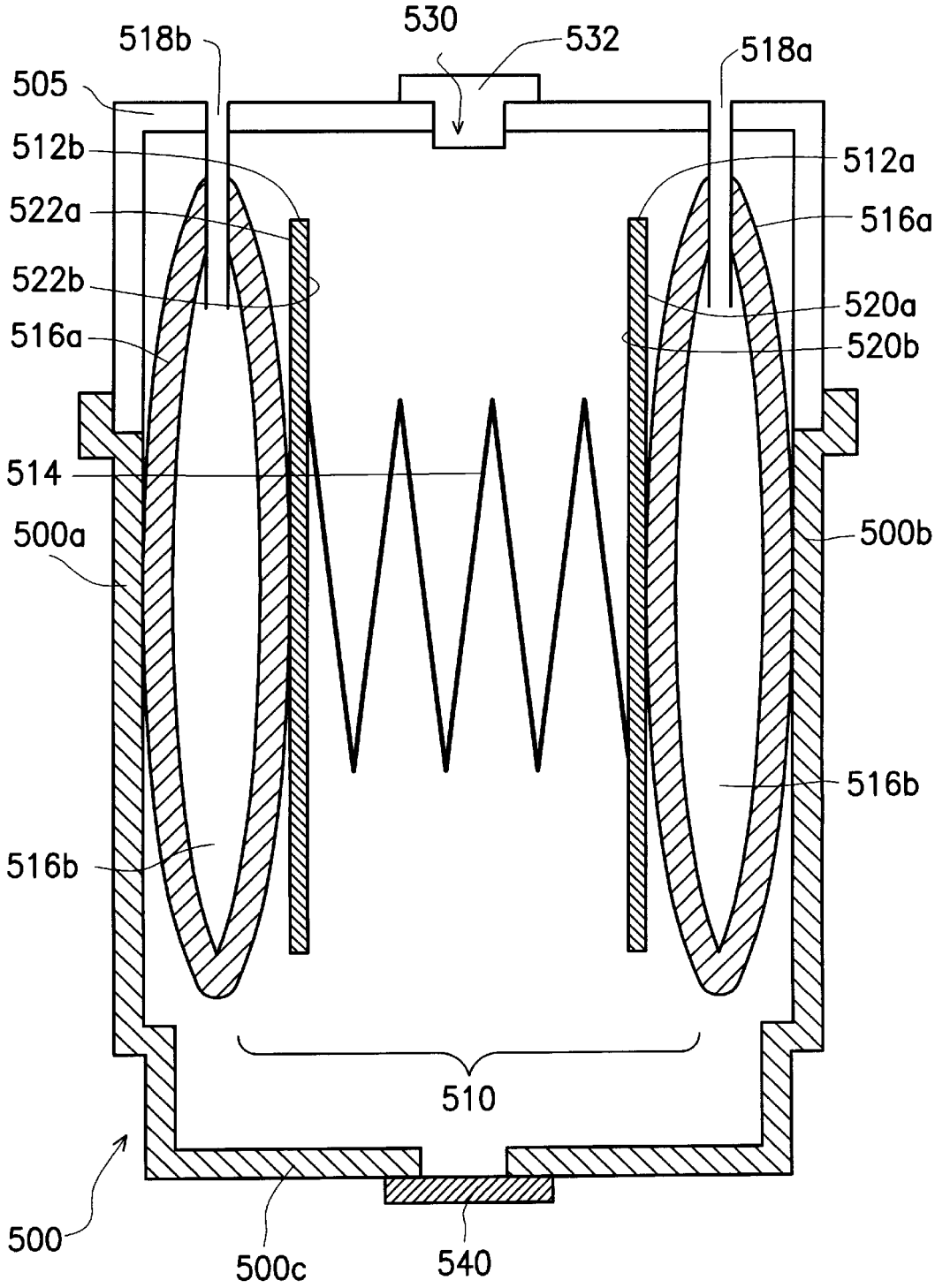

FIGS. 4A and 4B are cross-sectional views showing the components inside an ink-jet pen including a number of expandable bags (for example, two separate bags) in the expanded/contracted position to another embodiment of this invention.

As show in FIG. 4A, the ink-jet pen 500 is actually a reservoir having rigid sidewalls 500*a*, 500*b*, 500*c* and a cap 505. Inside the ink-jet pen 500, there is an accumulator 510. The accumulator 510 is in fact an assembly of components that includes a number of pressure plates (for example, two plates 512*a*, 512*b*), a spring 514 and two expandable bags 516*a*, 516*b*. The bags 516*a*, 516*b* are connected to ambient air via connecting pipes 518*a*, 518*b*. Consequently, ambient air is able to flow into and out of the bag 516*a*, 516*b*. The connecting pipes 518*a*, 518*b* passe through the cap 505 of the ink-jet pen 500 with its end tightly sealed. Therefore, the only path for air into and out of the bags 516*a*, 516*b* are through the connecting pipes 518*a*, 518*b*.

As shown in FIG. 4A, one side of the bags 516*a*, 516*b* are respectively in contact with the inner sidewall 500*b* and 500*a* of the ink-jet pen 500 while the other side of the bags 516*a*, 516*b* are respectively in contact with the first side 520*a*, 522*a* of the pressure plates 512*a*, 512*b*. The second side 520*b*, 522*b* of the pressure plates 512*a*, 512*b* is supported by ends of the spring 514.

With the accumulator 510 in place, the reservoir is filled with ink through a sealable port 530. After the ink-jet pen 500 is filled, a seal cap 532 is used to seal off the port 530 so that the ink-jet pen 500 is cut off from direct contact with the atmosphere. At this moment, a minimum back pressure is established within the pen reservoir 500. The minimum back pressure can prevent ink leaking through the print head 540 when the print head 540 is inactive.

When the ink-jet pen 500 is used for printing, the air pressure within the reservoir decreases as ink is depleted. Hence, the back pressure increases. During printing, the bags 516*a*, 516*b* expand as shown in FIG. 4A. As the bags 516*a*, 516*b* expand, they will push on the pressure plates 512*a*, 512*b*, respectively and compress the spring 518 thereby reducing the volume of the reservoir to maintain the reservoir back pressure within a adequate level such that the print head 540 is able to continue ejecting ink from the reservoir.

When ambient air pressure decreases, for example, during air transportation of the pen, the spring 514 will push the pressure plates 512*a*, 512*b* against the bags 516*a*, 516*b* so that the bags 516*a*, 516*b* will contract due to a lower ambient pressure, as shown in FIG. 4B. The contraction of the bag 516*a*, 516*b* increase the volume of the pen reservoir so that the back pressure within the reservoir, relative to ambient, does not drop to a level that permits ink to leak from the print head 540.

EXAMPLE 3

Figure 5:
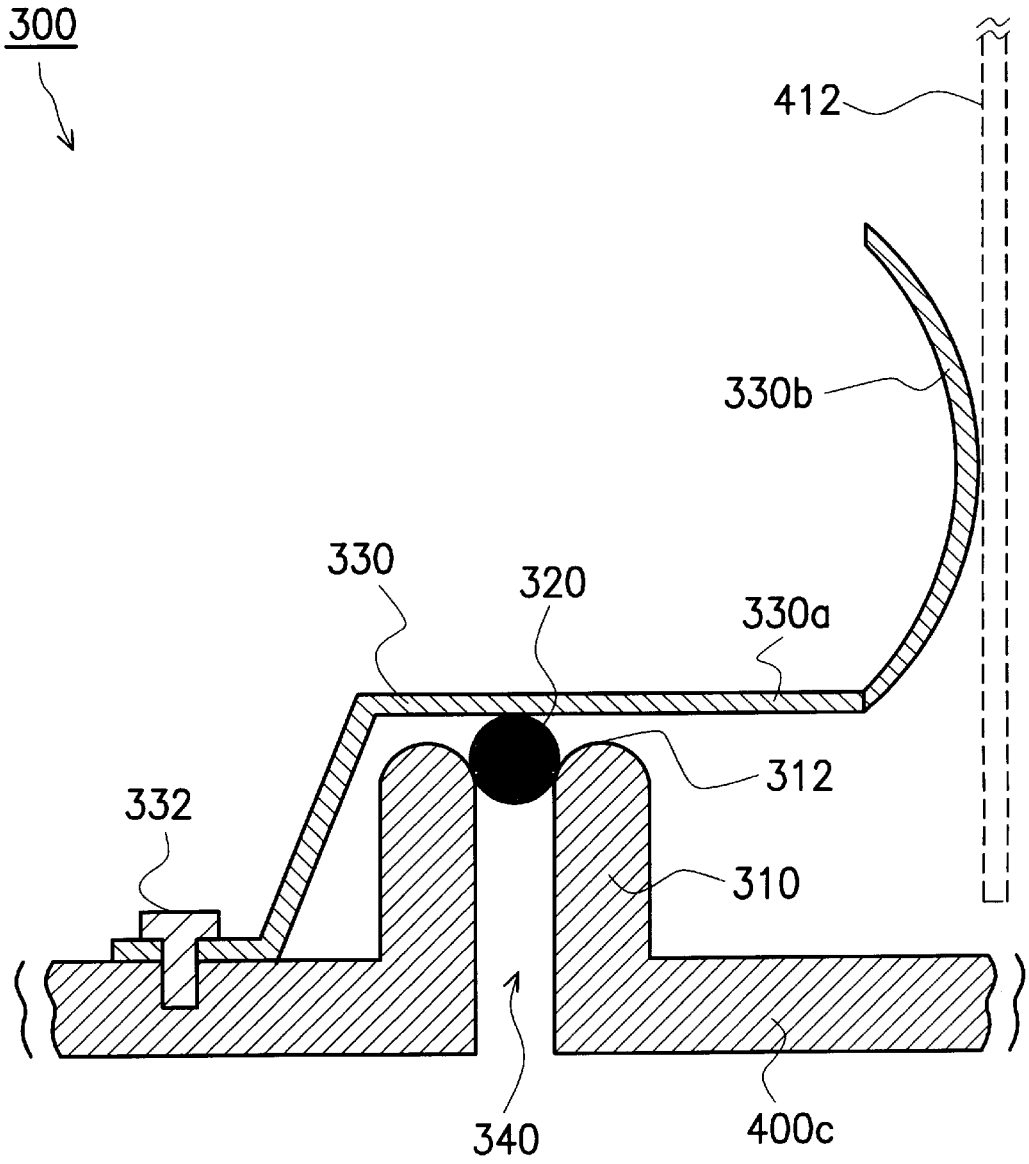
FIG. 5 is a cross-sectional view showing a pressure control device according to this invention.

FIG. 5 is a cross-sectional view showing a pressure control device according to this invention. The pressure control device is installed at the bottom part 400*c* of an ink-jet pen 400. Position of the pressure control device includes a tubular boss 310 having an arc surface 312 at its upper end. A sphere 320 sits on top of the arc surface 312. Ideally, the sphere 320 should form a line contact with the arc surface 312 of the boss 310. A flat spring 330 is fixed by a rivet 332 to the bottom 400*c* of the ink-jet pen. The flat spring 330 includes a first portion 330*a* and a second portion 330*b*. The first portion 330*a* of the flat spring 330 will press on the sphere 320 tightly while the second portion 330*b* is in contact with a pressure plate 412 next to it. In addition, there is an expandable bag 416 on one side of the ink-jet pens 400. As the bag 416 expands, the pressure plate 412 will push the second portion 330*b* of the flat spring 330, thus lifting the first portion 330*a* away from the sphere 320. Due to back pressure inside the ink-jet pen, the back pressure overcomes the capillary forces of the ink and the sphere 320 will become afloat for a while because ambient air is bubbling into the reservoir to reduce the back pressure.

Figure 6:
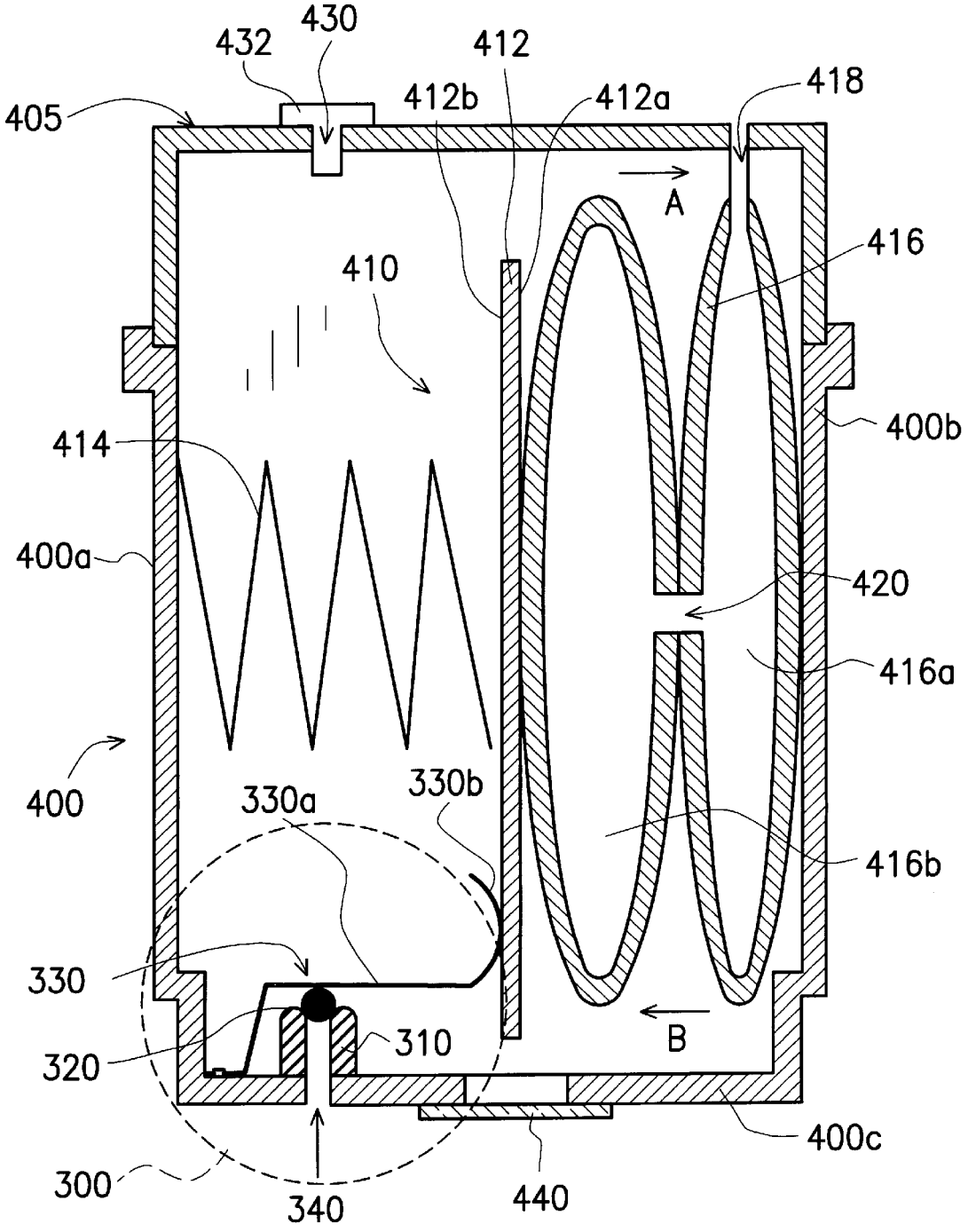
FIG. 6 is a cross-sectional view showing the components inside an ink-jet reservoir including an expandable bag in the contacted position according to the embodiment of this invention.

FIG. 6 is cross-sectional view showing the components inside an ink-jet pen including an expandable bag 416 in the contracted position to the embodiment of this invention. As show in FIG. 6, the ink-jet pen 400 is actually a reservoir having rigid sidewalls 400*a*, 400*b*, 400*c* and a cap 405. Inside the ink-jet pen 400, there is an accumulator 410. The accumulator 410 is in fact an assembly of components that includes a pressure plate 412, a spring 414 and an expandable bag 416. The bag 416 further includes a first chamber 416*a* and a second chamber 416*b*. The first chamber 416*a* is connected to ambient air via a connecting pipe 418. Consequently, ambient air is able to flow into and out of the bag 416. The connecting pipe 418 passes through the cap 405 of the ink-jet pen with its end tightly sealed. Therefore, the only path for air into and out of the bag is through the connecting pipe 418. Between the first chamber 416*a* and the second chamber 416*b*, there is an opening 420 permitting the flow of air between the chambers.

One side of the bag 416 is in contact with the inner side wall 400*b* of the ink-jet pen 400 while the other side of the bag 416 is in contact with the first side 412*a* of the pressure plate 412. The second side 412*b* of the pressure plate 412 is supported by one end of the spring 414 while the other end of the spring 414 is supported by the inner side wall 400*a* of the ink-jet pen 400.

With the accumulator 410 in place, the reservoir is filled with ink through a sealable port 430. After the ink-jet pen 400 is filled, a seal cap 432 is used to seal off the port 430 so that the ink-jet pen 400 is cut off from direct contact with the atmosphere. At this moment, a minimum back pressure is established within the pen reservoir. The minimum back pressure can prevent ink leaking through the print head 440 when the print head 440 is inactive.

When the ink-jet pen 400 is used for printing, the air pressure within the reservoir decreases as ink is depleted. Hence, the back pressure increases. During printing, the bag 416 will then expand as shown in FIG. 6. As the bag 416 expands, it will push on the pressure plate 412 and compress the spring 414 thereby reducing the volume of the reservoir to maintain the reservoir back pressure within a adequate level such that the print head 440 is able to continue ejecting ink from the reservoir. When ambient air pressure decreases, for example, during air transportation of the pen, the spring 414 will push the pressure plate 412 against the bag 416 so that the bag 416 will contract due to a lower ambient pressure. The contraction of the bag 416 will increase the volume of the pen reservoir so that the back pressure within the reservoir, relative to ambient, does not drop to a level that permits ink to leak from the print head 440.

As the bag 416 expands to its largest possible expandable volume, reservoir volume can not change further. From this moment on, if the print head 440 continues to eject ink, back pressure within the reservoir will increase to a level that the print head 440 will no longer be able to overcome the back pressure such that the print head stop ejecting ink. Therefore, it is the object of the invention to provide device for regulating the pressure in an ink-jet pen that minimizes the amount of unusable ink which is discarded with an ink-jet pen that stops printing because the back pressure exceeded the operating range.

Figure 7:
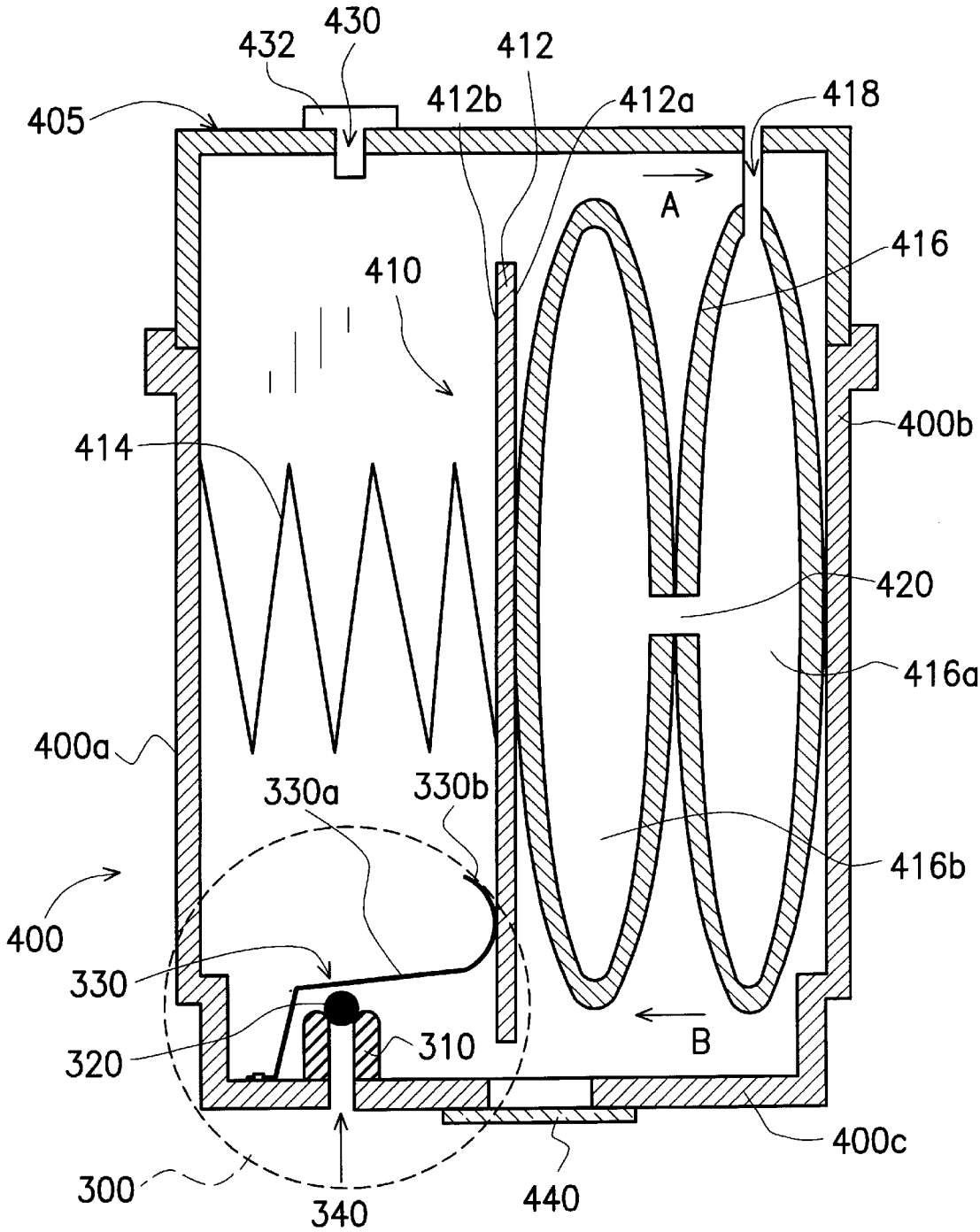
FIG. 7 is a cross-sectional view showing the components inside an ink-jet reservoir including an expandable bag in the expanded position according to the embodiment of this invention.

FIG. 7 is a cross-sectional view showing the components inside an ink-jet pen including an expandable bag in the expanded position according to the embodiment of this invention. As shown in FIG. 7, as bag 416 continues to expand (in direction B), the pressure plate 412 will be pushed sideways. The lower portion of the pressure plate 412 is in contact with the second portion 330*b* of the flat spring 330. Due to compression by the pressure plate 412, the first portion 330*a* of the flat spring 330 will be lifted up such that the first portion 330*a* and the sphere 320 are separated. When the flat spring 330 is no longer pressing on the sphere 320, the back pressure within the reservoir will make the sphere 320 be uplifted briefly to create a gap between the tubular boss 310 and the sphere 320. Consequently, the back pressure overcomes the capillary forces of the ink so that ambient air is bubbling into the reservoir to reduce the back pressure.

As ambient air is bubbled into the reservoir, the back pressure within the reservoir will decrease, thus the bag 416 will move sideways in the direction A due to the compression of the spring 414. At this moment, the flat spring 330 is no longer pushed by the pressure plate 412. Under its restorative force, the flat spring 330 moves back (as shown in FIG. 6) and the first portion 330*a* of the flat spring 330 is again pressing on the sphere 320 to seal off the boss 310. Once the boss 310 is re-sealed, air can no longer enter the pen reservoir.

The ink-jet pen 400 will alternate between the configuration as shown in FIG. 7 and the one shown in FIG. 6 as ink continues to drop through paper printing operations.

Figure 8:
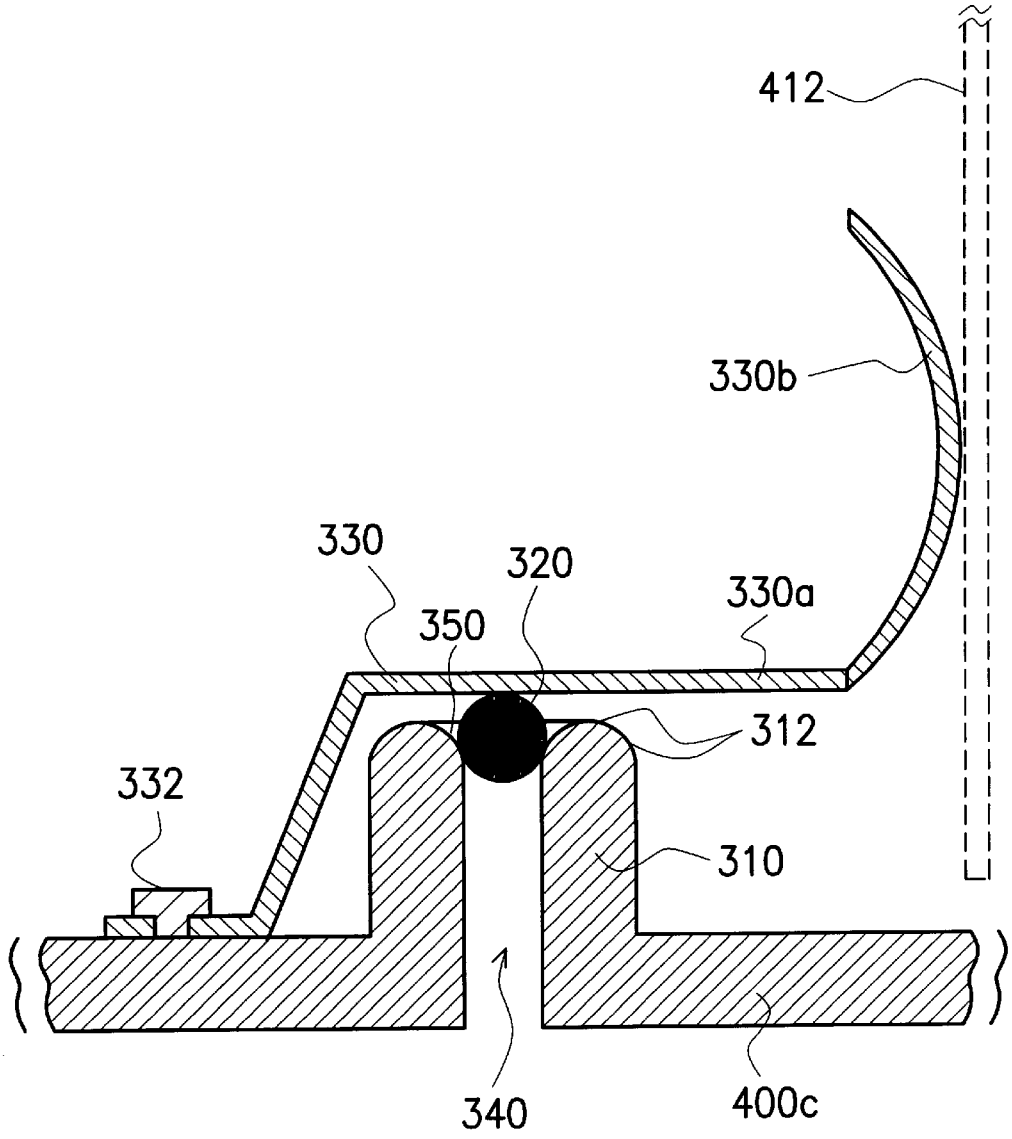
FIG. 8 is a cross-sectional view showing the liquid seal established by the pressure control device of this invention.

In addition, liquid sealing and self-wetting capability are also provided by the pressure control device of this invention. FIG. 8 is cross-sectional view showing the liquid seal on the pressure control device of this invention. The space from the circular contact line (formed by the sphere 320 sitting on the boss 310) to the uppermost rim of the boss 310 can trap a quantity of ink due to the capillary of the ink. This pool of ink constitutes a liquid seal and having a self-wetting capability.

In summary, advantages of using the pressure control device of this invention to operate an ink-jet print head includes:

1. The pressure control device of this invention is able to provide a back pressure within the pen reservoir unaffected by surface tension of the type of ink used. Actual testing reveals that conventional pressure control device can have a variation of about 2 to 3 cm-WC within the ink-jet reservoir when different types of inks are used.

Figure 9:
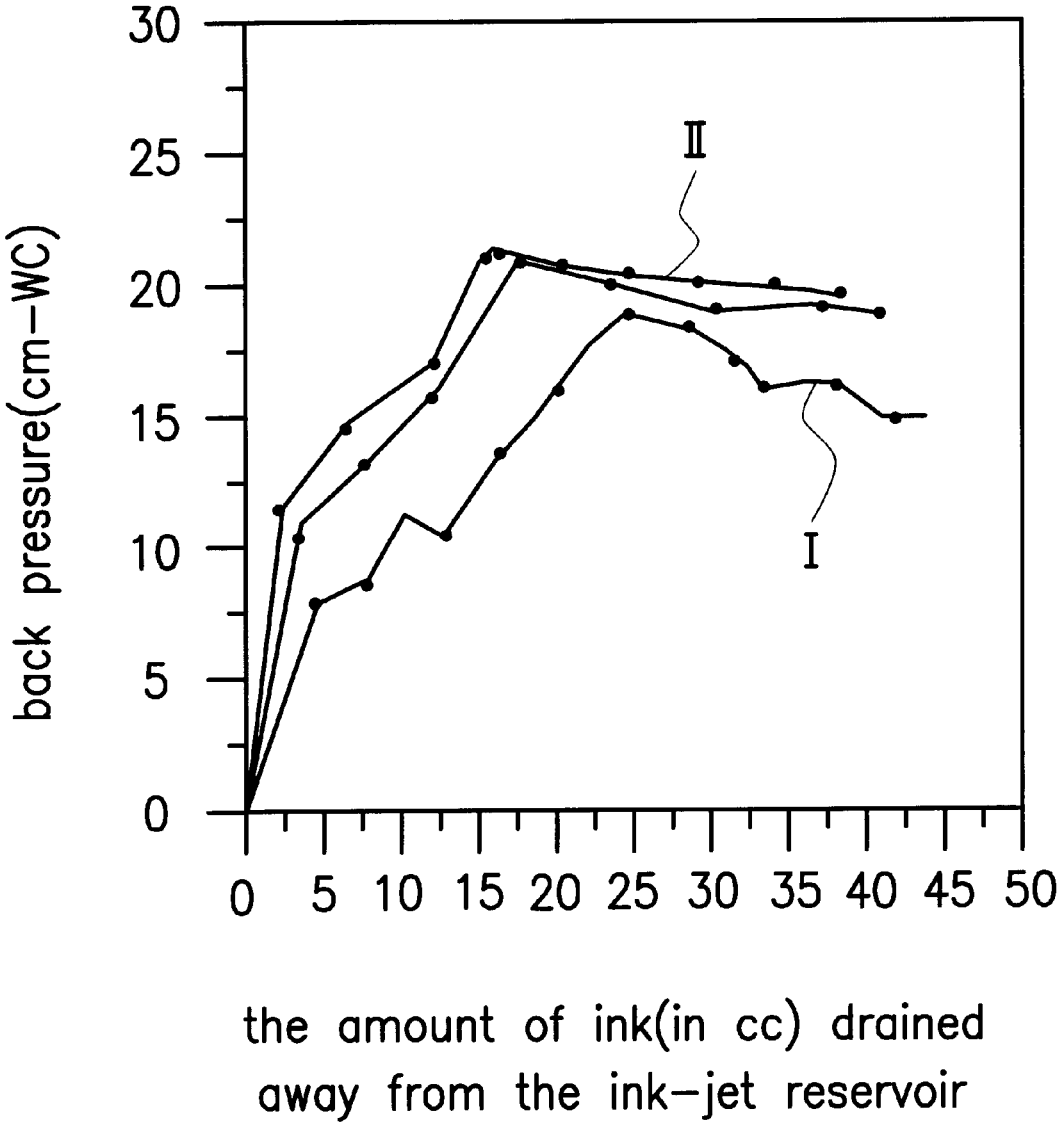
FIG. 9 is a graph comparing variation of back pressures versus the amount of ink (in cc) drained away from the ink-jet reservoir between a conventional controller and the pressure control device of this invention.

2. The pressure control device of this invention is capable of providing a back pressure within the ink-jet that varies within a smaller level as shown in FIG. 9. Conventional device produces a back pressure (curve I) between 13 to 18 cm-WC, a variation of about 5 cm-WC. The device of this invention, however, is able to produce a back pressure (curve II) between 18 to 21 cm-WC, which is a variation of only 3 cm-WC. Hence, a better print quality is obtained because the variation of the back pressure that the print head has to overcome is minimized.

3. The pressure control device does not require precise control of gap dimension between the sphere and the tubular boss. Therefore, the back pressure at which air bubbles into the reservoir can be controlled precisely.

4. The pressure control device is constructed using simple components, which does not occupy much reservoir space. Moreover, the components are easy to manufacture and easy to assembly, therefore production cost is low.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pressure control device installed inside a substantially sealed reservoir containing ink and maintaining a back pressure established therein, comprising:

a tubular boss associated with said reservoir, said boss has an arc surface at its upper end;

a sphere positioned on top of the upper opening of the boss forming a contact line to control ambient air exchange between the sealed reservoir and the external environment; and a spring device having two portions that connected together, the first portion of the spring presses tightly upon the sphere whereas the second portion of the spring is coupled to an accumulator inside the reservoir, so that as back pressure changes, the accumulator is able to press upon the second portion of the spring, thus lifting the first portion away from the sphere.

2. The pressure control device of claim 1, wherein the external environment with respect to the sealed reservoir refers to the atmosphere.

3. The pressure control device of claim 1, wherein the spring device that comprises the first and second portions is a spring made from stainless steel.

4. The pressure control device of claim 1, wherein the accumulator comprises:

a pressure place;

an expandable bag with one side attached to a first interior sidewall of the sealed reservior and the other side attached to one side of the pressure plate, wherein the expandable bag includes a short venting pipe passing through the sealed reservoir for communicating with outside; and a second spring with one end of the second spring attached to the other side of the pressure plate while the other end of the second spring is attached to a second interior sidewall on the opposite side of the first interior sidewall of the sealed reservoir.

5. A pen for ink-jet printer, comprising a sealed reservoir for containing ink having a back pressure inside;

a pressure control device installed inside the sealed reservoir, including:

a tubular boss associated with said reservoir, said boss has an arc surface at its upper end;

a sphere positioned on top of the upper opening of the boss forming a contact line to control ambient air exchange between the sealed reservoir and the external environment; and a spring device having two portions that connected together, the first portion of the spring presses tightly upon the sphere whereas the second portion of the spring is coupled to a accumulator inside the reservoir, so that as back pressure changes, the accumulator is able to press upon the second portion of the spring, thus lifting the first portion away from the sphere; and a print head located at the bottom of the sealed reservoir.

6. The ink-jet pen of claim 5, wherein the external environment with respect to the sealed reservoir refers to the atmosphere.

7. The ink-jet pen of claim 5, wherein the spring device that includes the first and second portions is a spring made from stainless steel.

8. The ink-jet pen of claim 5, wherein the accumulator further includes: a pressure plate; an expandable bag with one side attached to a first interior sidewall of the sealed reservoir and the other side of the pressure plate, wherein the expandable bag further includes a short venting pipe passing through the sealed reservoir for communicating with air outside; and a second spring with one end of the second spring attached to a second interior sidewall on the opposite side of the first interior sidewall of the sealed reservoir.

9. A method of controlling the back pressure within the sealed reservoir of an ink-jet pen using an accumulator and a pressure control device, wherein the accumulator comprises a pressure plate, an expandable bag with one side attached to a first interior sidewall of the sealed reservoir and the other side attached to one side of the pressure plate, wherein the expandable bag further includes a short venting pipe passing through the sealed reservoir for communicating with air outside, and a spring with one end attached to the other side of the pressure plate while the other end of the spring is attached to a second interior sidewall on the opposite side of the first interior sidewall of the sealed reservoir, comprising the steps of:

waiting for the accumulator to expand to a certain level;

permitting air to enter the sealed reservoir in the form of air bubbles through a tubular boss actuated by the accumulator and the pressure control device so that the accumulator is compressed; and repeating the whole process again in cycles.

10. The pressure controlling method of claim 9, wherein the pressure control device further comprises:

a tubular boss associated with said reservoir, said boss has an arc surface at its upper end;

a sphere positioned on top of the upper opening of the boss forming a contact line to control ambient air exchange between the sealed reservoir and the external environment; and a spring device having two portions that connected together, the first portion of the spring presses tightly upon the sphere whereas the second portion of the spring is coupled to a accumulator inside the reservoir, so that as back pressure changes, the accumulator is able to press upon the second portion of the spring, thus lifting the first portion away from the sphere.

* * * * *